United States Patent [19]

Henderson, Sr.

[11] Patent Number: 4,791,395

[45] Date of Patent: Dec. 13, 1988

[54] MAGNETIC CORE APPARATUS AND METHOD OF CONSTRUCTING THE SAME

[75] Inventor: Tony R. Henderson, Sr., Bluefield, W. Va.

[73] Assignee: American Telephone and Telegraph Company AT&T Bell Laboratories, Murray Hill, N.J.

[21] Appl. No.: 895,989

[22] Filed: Aug. 14, 1986

[51] Int. Cl.[4] ..... H01F 27/26; H01F 41/02

[52] U.S. Cl. ..... 336/210; 29/607; 156/85; 174/DIG. 8; 403/273

[58] Field of Search ..... 336/210, 212; 156/84, 156/85; 174/DIG. 8; 285/381; 29/606, 601, 608, 609; 403/273; 310/217, 218

[56] References Cited

U.S. PATENT DOCUMENTS

| | | | |
|---|---|---|---|
| 3,139,468 | 6/1964 | Wheat | 285/381 X |
| 3,171,091 | 2/1965 | Goldsmith | 174/DIG. 8 X |
| 3,554,999 | 1/1971 | Shaw et al. | 264/95 |
| 3,633,140 | 1/1972 | Lake et al. | 336/182 |
| 4,241,234 | 12/1980 | Haeder | 174/92 |
| 4,296,955 | 10/1981 | Martin | 285/381 |
| 4,304,616 | 12/1981 | Richardson | 156/86 |
| 4,472,702 | 9/1984 | Johansson et al. | 336/197 |

FOREIGN PATENT DOCUMENTS

| | | | |
|---|---|---|---|
| 1426617 | 3/1976 | United Kingdom | 174/DIG. 8 |

OTHER PUBLICATIONS

IBM Technical Disclosure Bulletin, "Attachable Heat Sink for Pluggable Modules", De Maine et al., vol. 22, No. 3, Aug. 1979, pp. 960–961.

IBM Technical Disclosure Bulletin, "Means of Attaching a Heat Sink to a Module", Kilburn et al., vol. 23, No. 11, Apr. 1981, p. 4850.

*Primary Examiner*—Thomas J. Kozma

*Attorney, Agent, or Firm*—Alfred G. Steinmetz

[57] ABSTRACT

A technique for assembling a transformer core from two separate core components uses a thermo shrinkable elastomer band or tubing in place of the more conventional glues and metallic clips to secure the component into a unitary structure. A thermo shrinkable mylar plastic tubing is placed around a periphery of a core formed by abutting two separate core components together so as to form a closed magnetic path. Application of heat shrinks the tubing and secures the two separate core components into one unitary core structure.

4 Claims, 2 Drawing Sheets

MAGNETIC CORE APPARATUS AND METHOD OF CONSTRUCTING THE SAME

FIELD OF THE INVENTION

This invention relates to magnetic components and in particular to a particular magnetic core construction and a method for assembling magnetic cores from separate core components and to the magnetic apparatus resulting therefrom.

BACKGROUND OF THE INVENTION

Magnetic cores for inductors and transformers are often constructed from two core components which are abutted together to form the desired unitary magnetic structure having a closed flux path. The two core components are normally secured together with a mechanical clamp that grips the two components together in the desired manner. In a conventional construction utilizing two "E" configured cores; the ends of the core protuberances are held in abutting relationship with each other by securing them together with a metallic frame and a spring-biased clip apparatus. An alternative method of securing the two core components together utilizes glue in the gap where the two components abut together. This second method may be supplementary to the first method described and both methods may be used in one construction. It has been found that magnetic cores made by the first method of construction are susceptible to vibration damage which may alter a critical air gap dimension and in addition it is a relatively costly construction method. Furthermore, the metallic frame and clip may provide spurious flux paths and degrade the core's magnetic performance. The use of glue has also been found to be unsatisfactory because it is dimensionally unstable during construction and stresses adjacent laminations and alters the air gap dimension.

BRIEF SUMMARY OF THE INVENTION

A technique fo assembling a transformer core from two separate core components uses a thermo shrinkable elastomer band or tubing in place of the more conventional glues and metallic clips to secure the components into a unitary structure. In a particular embodiment of the invention a thermo shrinkable mylar plastic tubing is placed around a periphery of a core formed by abutting two separate "E" configured core components together so as to form a closed magnetic path. Application of heat shrinks and thermosets the tubing and secures the two separate core components into one unitary core structure.

BRIEF DESCRIPTION OF THE DRAWING

An understanding of the invention may be readily attained by reference to the following specification and the accompanying drawing in which.

DETAILED DESCRIPTION

Figure 1:
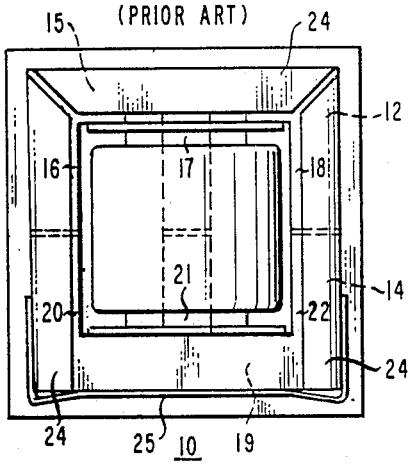
FIG. 1 (PRIOR ART)
FIGS. 1 and 2 are plan and elevation views of a prior art transformer construction whose two core components are secured together by a bracket and a clamp.
Figure 2:
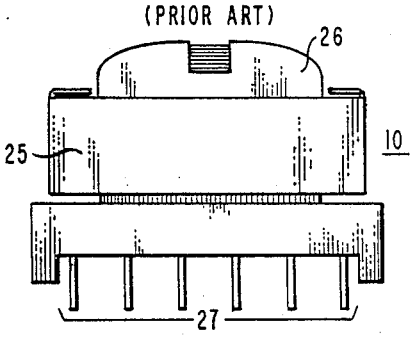
FIG. 2 (PRIOR ART)

A conventional transformer construction of the prior art is shown in plan and elevation views in FIGS. 1 and 2, respectively. A power transformer 10 is shown constructed with first and second "E" shaped individual core components 12 and 14, respectively. The first core 12 has a lower yoke portion 15 and three legs 16, 17, and 18; the second core 14 includes a yoke portion 19 and three legs 20, 21, and 22. The ends of legs 16, 17, and 18 are abutted against the ends of legs 20, 21, and 22 to form the closed flux paths of the transformer core. The abutting ends of each of the juxtaposed legs are normally opposing magnetic poles and the resulting magnetic attraction helps to secure the proper abutment of the two core components 12 and 14.

To maintain the proper abutment and secure a continuous solid core assembly, a bracket and an associated clamp are used to positively secure the two core sections 12 and 14 together. A three sided frame, 24, is fitted about one side of the yoke 15 of the assembled core and along the sides comprising the abutting legs 16–20 and 18–22, respectively. A U shaped spring clamp 25 is positioned along the yoke 19 to engage the free ends of the frame and secure it into place and thereby hold the two core components 12 and 14 together and in place to form the completed transformer core. The pins 27, shown in FIG. 2 are utilized for connection with corresponding receptacles of a circuit board. The windings 28 are wound on a bobbin, 26, whose end view is shown in FIG. 2.

Figure 3:
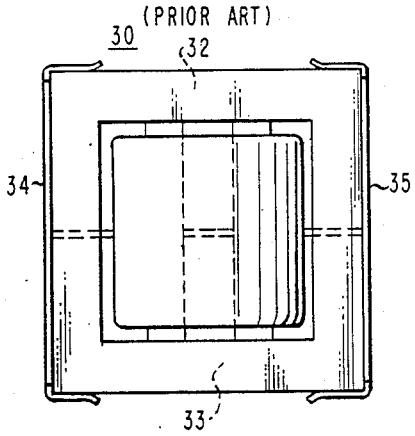
FIG. 3 (PRIOR ART)
FIGS. 3 and 4 are plan and elevation views of another prior art transformer construction whose two core components are secured together by two spring clamps.
Figure 4:
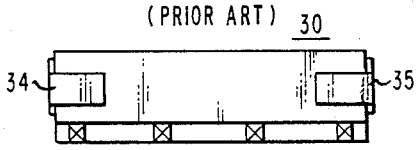
FIG. 4 (PRIOR ART)

Another conventional prior art transformer construction is shown in plan and elevation views in FIGS. 3 and 4, respectively. In the thinner surface mount transformer 30 shown, two "E" shaped cores 32 and 33, are held together by two U shaped spring clamps 34 and 35 each of which contact and supply force to the end yokes of the two core components in order to force the opposing legs of the two core components 32 and 33 together.

In some instances the gap between the abutting legs of the two core components of both the aforementioned contacts may be glue filled to provide adhesion and control the gap between the two.

The aforementioned construction methods in some instances may adversely affect the magnetic performance of the transformer core. The metallic frame and clips being in pressure contact with the core may adversely affect the flux path and the flux distribution of the flux conducted by the transformer core. The glue used in the airgap tends to be dimensionally unstable when subjected to thermal stress and may forcefully alter the airgap width and/or defect the laminations of the cores at the airgap.

Figure 5:
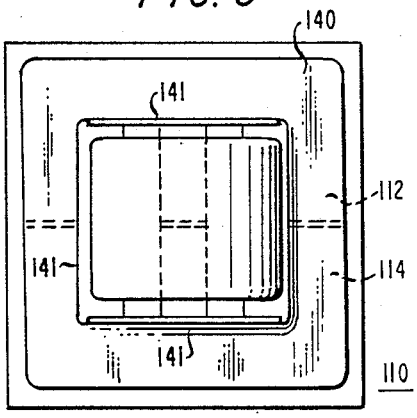
FIGS. 5 and 6 are plan and elevation views of a transformer construction embodying the principles of the invention wherein the two core components are secured together by a thermosetting elastomer tubing.
Figure 6:
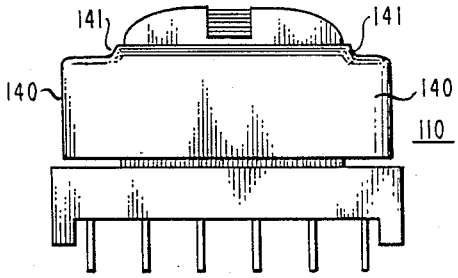

A transformer core construction embodying the principles of the invention is shown in plan and elevation views in FIGS. 5 and 6, respectively. The transformer 110 shown is similar in form and function to the transformer in FIGS. 1 through 4, except the two core components 112 and 114 are secured together by an elastomer holder 140 in place of the aforedescribed metallic frame, spring clip, and glue.

The elastomer holder 140 is a continuous tubing that fits initially loosely around the perimeter of the transformer core formed by abutment of the two core components 112 and 114. The elastomer is made of a nonmetallic thermo setting elastic material. The tubing 140 is initially stretched and of sufficient width to fully cover the width of the stacked laminations of the core and the top surface of the top lamination to edge 141, and is of sufficient diameter to readily surround the perimeter of the core formed by the abutting core components. A suitable elastomer material for example is stretched mylar plastic. The tubing in its stretched condition is placed around the perimeter of the two abutted core components 112 and 114 and heat from a hot airgun is applied uniformly and repeatedly about the surface of the elastomer to cause it to shrink about the core and as shown hold the two core components 112 and 114 into a secure abutting arrangement. This technique of securing the two core components 112 and 114 together does not require application of glue or provide spurious flux paths and it provides a strong uniform compressive force at the abutting surfaces of the two core component 112 and 114. It also advantageously provides a shield for the core from dirt and contaminating elements.

Figure 7:
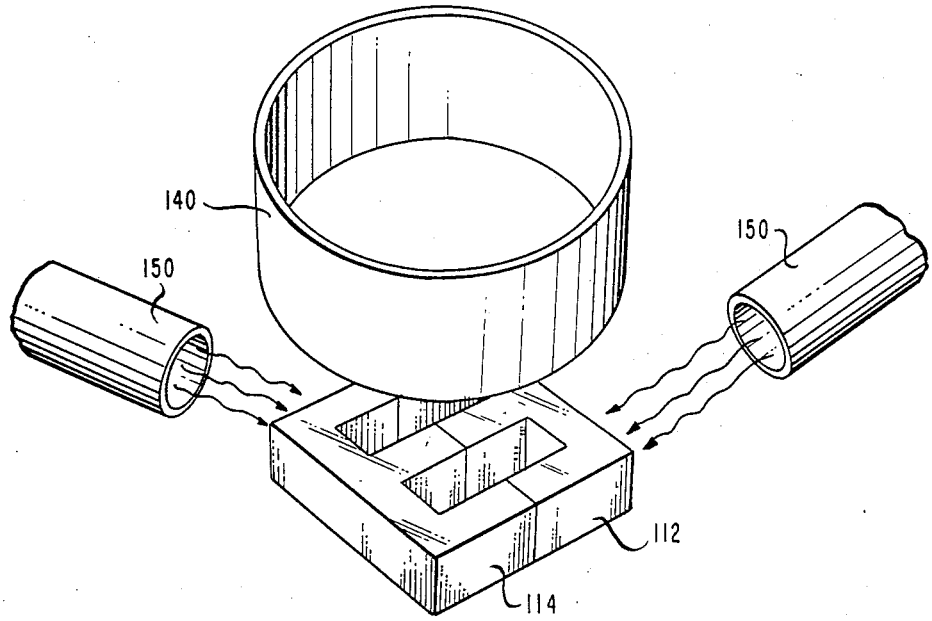
FIG. 7 is a perspective view of a technique by which the magnetic core apparatus is assembled.

The technique of construction may be readily appreciated from the perspective view shown in FIG. 7 of two abutting core components 112 and 114 positioned to receive a stretched elastomer tubing 140 positioned to be placed around the periphery at the core. Hot airguns 150 are positioned to heat the tubing thereby causing it to thermally shrink and secure the two core components together. In order to heat the tubing uniformly, the core may be rotated or a plurality of airguns may be positioned around the core.

What is claimed is:

1. A magnetic core comprising:

a first core component, a second core component, the first and second core components juxtaposed with cross sections of flux paths of the first and second core components in direct physical contact in order to form at least one continuous closed flux path through the first and second core components as combined, a continuous strip of heat shrinkable elastomer material positioned to encircle a perimeter of the first and second core components as juxtaposed, the continuous strip of heat shrinkable elastomer material having been heated so as to shrink and forcefully hold the first and second core components together as juxtaposed.

2. A magnetic core as defined in claim 1 wherein the first and second core components each have an "E" shaped contour and are juxtaposed with ends of legs at the first and second core components being adjacent to each other, and the continuous strip of heat shrinkable material comprising a tubular shape having sufficient width so as to overlap a top surface of the magnetic core after being shrunk.

3. A method of constructing a unitary magnetic core from first and second core components comprising the steps of positioning cross sectional cuts of an intended flux path of a first and second core component adjacent each other in direct physical contact so that individual flux paths of each of the first and second cores are serially connected to permit one continuous intended flux path threading through the first and second core components, positioning a continuous strip of heat shrinkable elastomer material around an outer perimeter formed by the positioning of the first and second core components, and applying heat to shrink the continuous strip of heat shrinkable elastomer material and forcibly secure the first and second core components together.

4. A method of constructing a unitary magnetic core from first and second core components as defined in claim 3 and further comprising the step of prestretching the continuous strip of heat shrinkable elastomer material before positioning it around the outer perimeter.

* * * * *